US007730808B2

(12) United States Patent
Chiu et al.

(10) Patent No.: US 7,730,808 B2
(45) Date of Patent: Jun. 8, 2010

(54) CERAMIC BLADES AND FABRICATION METHODS THEREOF

(75) Inventors: Kuo-Chuang Chiu, Hsinchu (TW); Ren-Der Jean, Hsinchu (TW); Chuan-Lung Lu, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 1065 days.

(21) Appl. No.: 11/149,316

(22) Filed: Jun. 10, 2005

(65) Prior Publication Data

US 2006/0062675 A1 Mar. 23, 2006

(30) Foreign Application Priority Data

Sep. 23, 2004 (TW) ..... 93128828 A

(51) Int. Cl.
*B21K 11/00* (2006.01)

(52) U.S. Cl. ..... 76/104.1; 264/650

(58) Field of Classification Search ..... 76/104; 264/650

See application file for complete search history.

(56) References Cited

U.S. PATENT DOCUMENTS

| | | | | | |
|---|---|---|---|---|---|
| 3,543,402 | A * | 12/1970 | Seager | ..... | 30/346.53 |
| 3,911,579 | A * | 10/1975 | Lane et al. | ..... | 30/346.54 |
| 4,289,719 | A * | 9/1981 | McIntosh et al. | ..... | 29/830 |
| 5,048,191 | A | 9/1991 | Hahn | | |
| 5,056,227 | A | 10/1991 | Kramer | | |
| 5,121,660 | A | 6/1992 | Kramer | | |
| 5,814,262 | A * | 9/1998 | Ketcham et al. | ..... | 264/316 |
| 6,151,786 | A | 11/2000 | Hellstern | | |
| 6,326,079 | B1 * | 12/2001 | Philippe et al. | ..... | 428/325 |
| 7,056,468 | B2 * | 6/2006 | Chiu et al. | ..... | 264/650 |
| 7,223,523 | B2 * | 5/2007 | Boykin et al. | ..... | 430/273.1 |
| 2005/0003078 | A1 * | 1/2005 | Lu et al. | ..... | 427/126.3 |

* cited by examiner

*Primary Examiner*—Joseph J Hail, III
*Assistant Examiner*—Shantese McDonald
(74) *Attorney, Agent, or Firm*—Birch, Stewart, Kolasch & Birch, LLP

(57) ABSTRACT

Ceramic blades and fabrication methods thereof. A ceramic blade comprises a ceramic body having two sides and an edge. A coating layer is applied on the two sides and the edge, wherein the ceramic body is formed using a scraper to create substantially flat surface and to prevent residual stress damage.

6 Claims, 3 Drawing Sheets

CERAMIC BLADES AND FABRICATION METHODS THEREOF

BACKGROUND

The invention relates to ceramic blades and fabrication methods thereof, and more particularly, to ceramic blades with nano-structured photocatalysis thereon and fabrication methods thereof.

Ceramic blades typically exhibit excellent mechanical characteristics such as high hardness, anti-corrosion capability, wear resistance, and suitability for a variety of applications such as of cutting tools, fruit knifes, pen knifes and razors.

Conventional ceramic blades are formed as green ceramic bodies by molding or injection and subsequently sintered. Since the ceramic bodies are quite thick, further machining treatments such as cutting and polishing are required to thin the ceramic bodies and create edges. However, machining treatments may cause surface roughness and defects such as induced residual stress.

U.S. Pat. No. 6,151,786, the entirety of which is hereby incorporated by reference, discloses a ceramic blade formed by injection. Injection alone, however, cannot directly form a thin blade, thereby applications of the injected ceramic blade are restricted.

U.S. Pat. Nos. 5,121,660, 5,048,191, and 5,056,227 the entirety of which are hereby incorporated by reference, disclose ceramic blades mechanically treated by, for example, grinding and polishing, to reach a desired thickness. Mechanical treatments may, however, cause surface roughness and induced residual stress. Thus, an additional protective layer is required to increase strength and toughness. These mechanical treatments and extra process may, however, increase production complexity and cost.

SUMMARY

Ceramic blades and fabrication methods thereof employ tape casting to form green ceramic bodies. After the green ceramic bodies are sintered and co-fired, the thickness and surface flatness uniformity of the ceramic blades are provided for preventing residual stress damage.

An exemplary embodiment of a ceramic blade comprises a ceramic body having two sides and an edge. A coating layer is applied on both sides and the edge, wherein the ceramic body is formed using a scraper to create a substantially flat surface and prevent residual stress damage.

An exemplary embodiment of a method for fabricating a ceramic blade comprises: providing a green ceramic band formed by tape casting; punching the green ceramic band into a green ceramic blade; sintering and co-fired the green ceramic blade to form a ceramic blade; grinding the ceramic sheet to create an edge; and applying a coating layer on both sides and the edge of the ceramic blades.

DESCRIPTION OF THE DRAWINGS

Ceramic blades and fabrication methods thereof will be better understood reference to the descriptions to be read in conjunction with the accompanying drawings, in which.

DETAILED DESCRIPTION

The invention is directed to ceramic blades with a nano-structured photocatalyst layer thereon and fabrication methods thereof. The ceramic blades are formed by tape casting and have thin and substantially flat surfaces, thereby preventing residual stress damage. Reference will now be made in detail to the preferred embodiments of the present invention, example of which is illustrated in the accompanying drawings.

Figure 1:
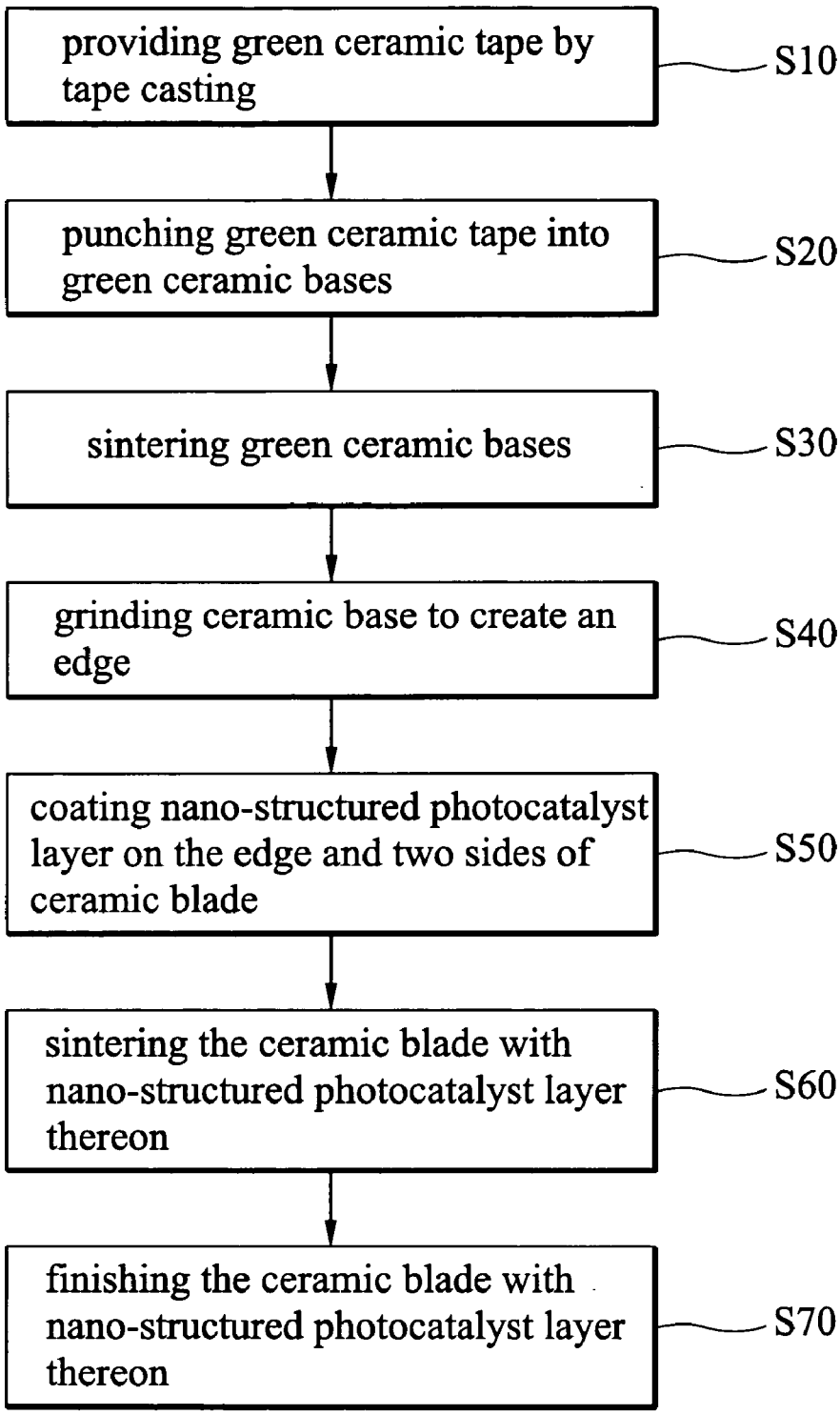
FIG. 1 is a flow chart showing steps for fabricating ceramic blades according to some embodiments of the invention.

FIG. 1 is a flow chart showing steps for fabricating ceramic blades according to the invention. A green ceramic tape is provided (S10). The green ceramic tape is formed by tape casting. The green ceramic tape is then punched into green ceramic bodies (S20). The green ceramic bodies are sintered and then co-fired to form ceramic bodies (S30). The ceramic body is edged to create an edge (S40). A nano-structured photocatalyst layer such as titanium oxide or zirconium oxide is coated on the edge and two sides of the ceramic blade (S50). The ceramic blade with the nano-structured photocatalyst layer thereon is subsequently sintered to adhere the nano-structured photocatalyst layer on the ceramic blade (S60). Thus, a ceramic blade with a nano-structured photocatalyst layer thereon is achieved (S70).

Tape casting is conventionally classified as a ceramic thick film technology. Ceramic slurry is provided by uniformly dispersing ceramic powders in organic solvent. The ceramic powders may preferably be aluminum oxide or zirconium oxide with particle size in a range approximately 0.1 to 5 μm. According to an embodiment of the invention, the solid content of the ceramic slurry is in a range of approximately 55% to 93%. The organic solvent may comprise methylbenzene, ethanol, n-Butyl Alcohol (NBA), or iso-Butyl Alcohol (IBA) . . . etc. In addition, the ceramic slurry may also comprise binder, disperser, and plasticizer, for example. The content of binder, disperser, and plasticizer may be approximately 7% to 45%.

With the addition of a binder, polymer functional groups or polar molecules may bond to inorganic ceramic particles. Ceramic particles can further bond by non-polar long chain absorption, thereby increasing strength of the green ceramic tape. According to some embodiments of the invention, the binder may comprise polyvinyl butyraldehyde (PVB), polyvinyl acetates (PVA), or acrylic resin. Disperser can adjust surface Zeta potential of inorganic particles to increase repulsion between inorganic particles and reduce agglomeration in the slurry, thus preventing defects during tape casting. The disperser may comprise KD-1 provided by ICI corp. The plasticizer can be cohered to the long chain polymer binder when long chain polymer binders are extended at higher temperature, thereby modifying physical characteristics of the binder, for example lowering glass transition temperature (Tg) of the binder or increasing fluidity of the binder. According to some embodiments of the invention, the plasticizer may comprise DOP, DBP, BBP or SG-160 provided by UPC Corp.

Subsequently, ceramic slurry is uniformly distributed on a membrane, such as Mylar by a scraper or a doctor blade. As the solvent evaporates, the ceramic particles can bond together via a binder to create green ceramic tape. The green ceramic tape is in a range of approximately 10-300 μm.

Figure 2:
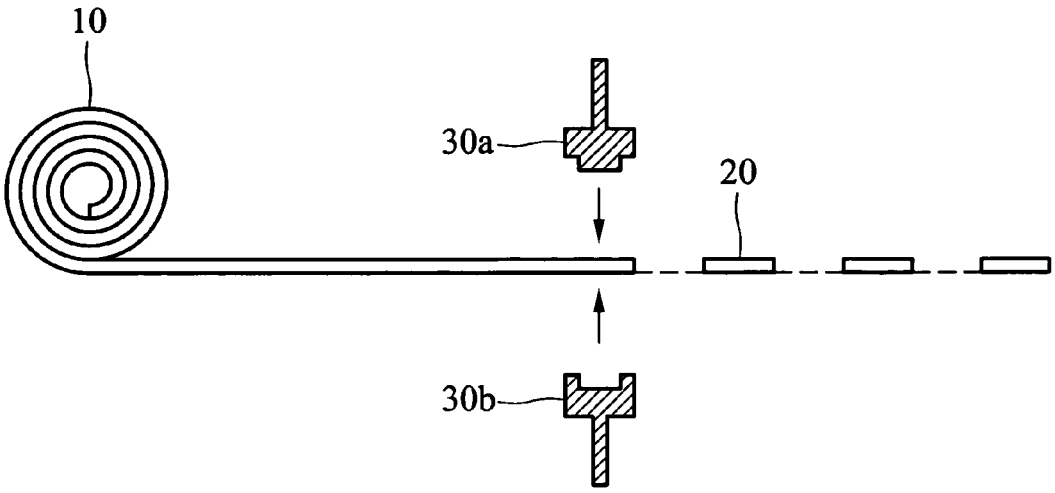
FIG. 2 is a schematic view of an exemplary embodiment of a green ceramic tape punched into green ceramic blades.

FIG. 2 is a schematic view showing a green ceramic tape punched into green ceramic blades. Referring to FIG. 2A, the green ceramic tape 10 is punched by a punching machine into green ceramic bodies 20. The punching machine may comprise a die and an upper punch 30*a* and a lower punch 30*b*, for example.

Next, the green ceramic bodies 20 are sintered at 1250° C.-1650° C., 10-120 min and co-fired to form ceramic bodies. By controlling sintering temperature and heating rate, the thickness of the ceramic bodies can be formed in a range of approximately 50-200 μm and the uniformity can reach less than or equal to 0.4%. Therefore, no additional machining process is required. As such, the sintered ceramic blade 20 has substantially flat surface and free of residual stress defects.

Figure 3:
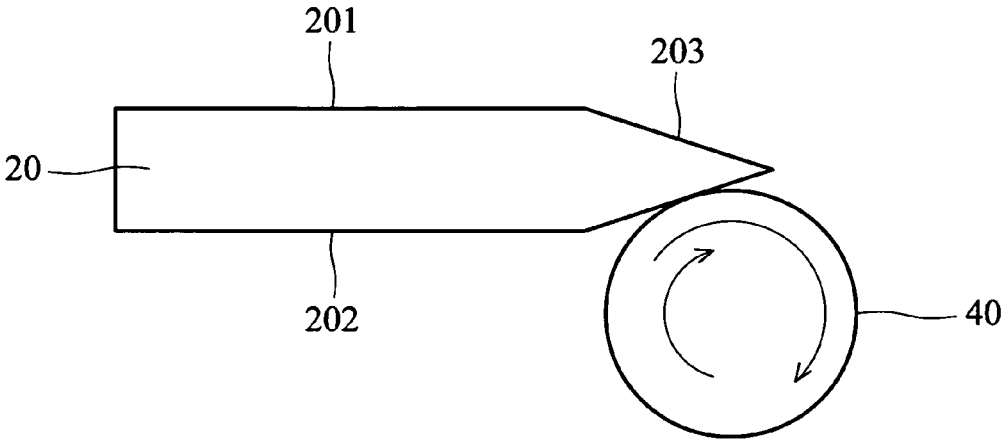
FIG. 3 is a schematic view of edging a ceramic bodies to form an edge according an embodiment of the invention.

FIG. 3 is a schematic view of edging the ceramic bodies to form an edge according to the invention. The ceramic blade 20 comprises two substantially plane sides 201, 202 and an edge 203. The grinding machine may, for example, comprise a diamond wheel 40 harder than the ceramic bodies.

Figure 4:
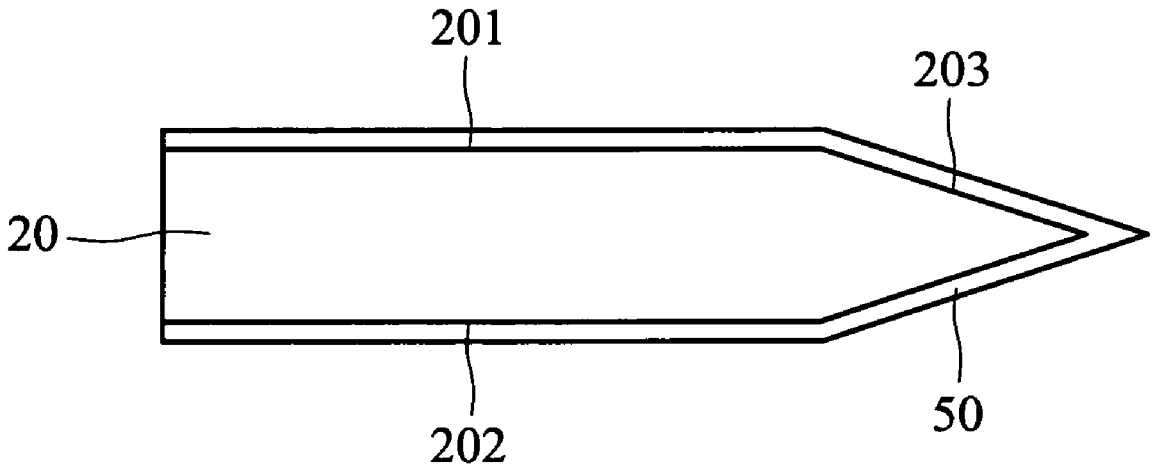
FIG. 4 is a schematic view of coating a nano-structured photocatalyst layer on the edge and sides of the ceramic blade according to an embodiment of the invention.

FIG. 4 is a schematic view of coating a nano-structured photocatalysis layer 50 on the edge 203 and two sides 201, 202 of the ceramic blade 20 according to the invention. The nano-structured photocatalysis layer 50 provides surface activation and anti-germ defense functions. The nano-structured photocatalyst may accelerate the photoreaction by interaction with the substrate in its ground or excited state and/or with a primary photoproduct, depending upon the mechanism of the photoreaction. After radiating UV light, the photocatalyst can transfer oxygen and $H_2O$ molecules into activated oxygen. Furthermore, the photocatalyst can also reduce bacteria, molds and odors. Dusts, bacteria, molds and odors are decomposed by photoreaction. The photocatalyst layer 50 may comprise nano titanium oxide or nano zirconium oxide with a thickness in a range of 10-500 nm. The photocatalyst layer 50 may be formed by spraying nano-scale titanium oxide or zirconium oxide . . . etc on the ceramic blade. The ceramic blade with the nano-structured photocatalysis thereon is sintered to bind the nano-structured photocatalysis layer on the ceramic blade.

While the invention has been described by way of example and in terms of preferred embodiment, it is to be understood that the inventions is not limited to the disclosed embodiments. To the contrary, it is intended to cover various modifications and similar arrangements (as would be apparent to those skilled in the art). Thus, the scope of the appended claims should be accorded the broadest interpretations so as to encompass all such modifications and similar arrangements.

What is claimed is:

1. A method of fabricating a ceramic blade, comprising:

providing a green ceramic tape formed by tape casting;

punching the green ceramic tape into a green ceramic blade;

sintering and co-firing the green ceramic blade to form a ceramic blade;

grinding the ceramic blade to create an edge;

applying a coating layer on two sides and the edge of the ceramic blades; and sintering the coating layer to bind the coating layer on the ceramic blade;

wherein the coating layer is a photocatalysis layer with surface activation and anti-germ ability.

2. The method as claimed in claim 1, wherein the band of green ceramic comprises zirconium oxide or aluminum oxide.

3. The method as claimed in claim 1, wherein the thickness of the ceramic blade is approximately 50-200 μm.

4. The method as claimed in claim 1, wherein the flatness uniformity of the ceramic blade is equal to or less than 0.4%.

5. The method as claimed in claim 1, wherein the coating layer is a layer of nano-scale titanium oxide particles or a layer of nano-scale silver particles.

6. The method as claimed in claim 1, wherein the thickness of the coating layer is about 100-500 nm.

* * * * *